United States Patent [19]

Robaldo

[11] 4,391,391

[45] Jul. 5, 1983

[54] SYRINGE FOR APPLYING ADHESIVE RESIN TO THE JUNCTIONS OF TENNIS RACKET NETTING

[76] Inventor: Aldo M. Robaldo, Corso Francia 33, Turin, Italy

[21] Appl. No.: 204,586

[22] Filed: Nov. 6, 1980

[30] Foreign Application Priority Data

Jan. 11, 1980 [IT] Italy ..... 52825/80[U]
Mar. 7, 1980 [IT] Italy ..... 53010/80[U]

[51] Int. Cl.[3] ..... B67D 5/00

[52] U.S. Cl. ..... 222/478; 222/565; 239/61; 401/28

[58] Field of Search ..... 239/61, 62, 86, 302, 239/525, 543; 222/478, 565, 209; 401/11, 12, 28

[56] References Cited

U.S. PATENT DOCUMENTS 1,262,134 4/1918 Stolle ..... 239/61
1,332,544 3/1920 Davis ..... 239/61
2,708,055 5/1955 Alexander ..... 222/478
4,119,022 10/1978 Dykes et al. ..... 222/565

FOREIGN PATENT DOCUMENTS 735313 5/1980 U.S.S.R. ..... 239/61

*Primary Examiner*—James B. Marbert
*Attorney, Agent, or Firm*—Maky, Renner, Otto & Boisselle

[57] ABSTRACT

A syringe for applying adhesive resin to the junctions of tennis racket netting, comprising a cylinder and a piston and two or four coextensive tubular spray nozzles projecting from the end of the cylinder opposed to the piston. By applying the spray nozzles to the corners of a junction between two strings of netting, equal amounts of adhesive can be discharged from said spray nozzles and these drops of adhesive will combine to form a solid connection of the two strings at their point of junction.

14 Claims, 5 Drawing Figures

SYRINGE FOR APPLYING ADHESIVE RESIN TO THE JUNCTIONS OF TENNIS RACKET NETTING

This invention relates to a syringe for applying adhesive resin to the junctions of tennis racket netting. The application of adhesive resin to the junctions of tennis racket netting is described in Applicant's Italian prior Utility Model Application No. 53847-B/78 filed Oct. 31, 1978.

As described in said prior application, the connection of the netting of tennis rackets at the points of junction of the netting by an appropriate adhesive offers certain advantages which are due mainly to a greater resiliency of the racket when being hit by a tennis ball. For achieving good results the connection between a pair of strings of the netting at their point of junction must be made with a very durable adhesive, preferably an epoxyde resin comprising two components, and this adhesive must be applied with great accuracy both with regard to the point of application and with regard to its dosage. This is therefore a delicate operation which requires a considerable amount of skill and time for obtaining satisfactory results.

It is therefore an object of the present invention to provide a syringe for applying adhesive resin to the junctions of tennis racket netting, which permits the epoxyde adhesive formed of a mixture of two components to be applied accurately with regard to the position of application and dosage without requiring particular skill of the operator or an excessive amount of time.

This object is achieved according to the present invention by providing a syringe comprising a cylinder and a piston and at least two adjacent parallel tubular spray nozzles extending from the end of the cylinder acted upon by the piston.

Preferably there may be four adjacent parallel tubular spray nozzles so that the adhesive can be applied simultaneously to the four corners of the string junction.

Two preferred embodiments of the invention will now be described by way of example and with reference to the accompanying drawings, in which:-

Figure 1:
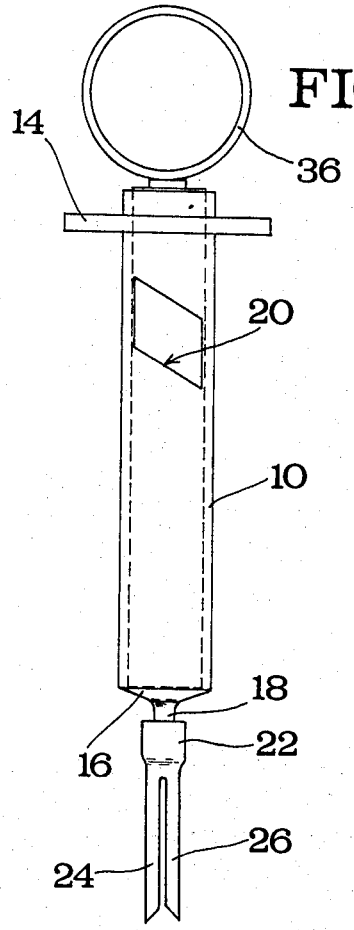
FIG. 1 is a side view of a syringe according to the invention in an embodiment having two adjacent parallel tubular spray nozzles.
Figure 2:
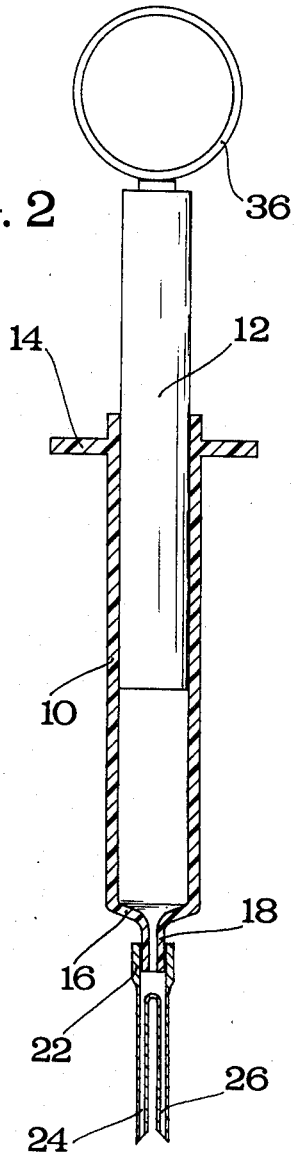
FIG. 2 is a longitudinal section through the syringe of FIG. 1 with the piston thereof shown in a partially extracted position.
Figure 3:
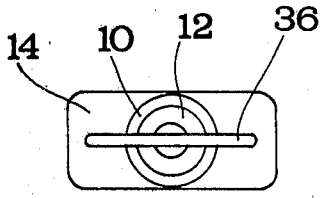
FIG. 3 is a top plan view of the syringe of FIGS. 1 and 2.

Referring to FIGS. 1 and 2 of the drawings, a syringe according to the invention comprises a cylinder 10 made preferably of moulded synthetic resin such as polystyrene or polyethylene of high density and a piston 12 likewise made of moulded synthetic resin and mounted for substantially sealing sliding movement within the cylinder 10.

The cylinder 10 has an upper open end from which the piston 12 projects and an elongated rectangular flange 14 serving as a handle is arranged near this upper open end. The bottom end 16 of the cylinder 10 narrows down into a connection nipple 18 for frictionally receiving a sleeve 22 having a pair of adjacent parallel tubular spray nozzles 24 and 26 extending symmetrically relative to the longitudinal axis of the cylinder 10 and terminating downwardly in an open spout end, these open spout ends being cut obliquely with the oblique cut being directed substantially toward the interior or longitudinal axis of the cylinder 10.

A rectangular, preferably rhomboidal, opening 20 is provided near the flange 14 in the peripheral wall of the cylinder 10 for purposes which will become evident in the course of the following description of the operation of the syringe. A ring 36 is secured to the free end of the piston 12 and serves as a handgrip for the operator who can push a thumb through this ring to gradually push the piston 12 into the cylinder 10 on actuation of the syringe.

For operation of the syringe the piston 12 is almost completely withdrawn from the cylinder 10 and a desired quantity of premixed fluid adhesive is introduced into the cylinder 10 through the opening 20. By introducing the adhesive mixture laterally into the cylinder 10 through the opening 20 instead of the end opening after extraction of the piston 12 air is prevented from being trapped in the cylinder 10, which might cause trouble in the operation of the device.

Figure 4:
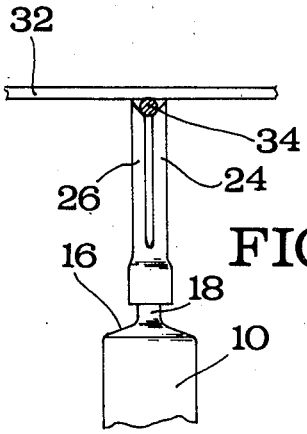
FIG. 4 is a partial side view of the syringe showing how it is applied to a junction between two strings of netting of a tennis racket.

Then the spray nozzles 24, 26 are placed on opposite sides of a string 34 of the netting of a tennis racket as shown in FIG. 4 adjacent a transverse string 32 and the piston 12 is gradually pushed into the cylinder 10 to squeeze two identical doses of liquid adhesive out of the spray nozzles 24 and 26. The liquid adhesive thus squeezed out forms two drops which will simultaneously adhere both to the string 34 and the string 32 at their common point of junction. The dosage will be empirically determined by the operator but however the doses may be, the two drops will always be identical in volume.

When the syringe is then removed from the racket, the two drops of deposited adhesive will flow together by capillary action into a single mass of adhesive uniformly distributed around the junction.

The frictional mounting of the spray nozzles 24, 26 on the connection nipple 18 permits the position of the spray nozzles relative to the handle 14 to be varied at a desired angle to facilitate operation of the syringe. Also such mounting permits to keep a stock of several spray nozzles of different spacing and/or diameter of the inner bore for adaptation to different types of adhesive or as preferred by the operator.

A typical inner diameter of the spray nozzles 24, 26 is, for example, 0.7 mm, but larger or smaller diameters may be used depending on the fluidity of the adhesive or the operator's preferences.

Although in the described preferred embodiment the spray nozzles 24, 26 are mounted by frictional engagement on the connection nipple 18, the spray nozzles may also be formed integrally with the cylinder 10. But in this case obviously the angle of the spray nozzles relative to the handle 14 cannot be changed although the cost of production will be reduced thereby.

The syringe may also be made of materials other than those previously mentioned and also the shape of the opening 20 may be different from the one shown or the opening may be omitted altogether where it is preferred to charge the syringe from the upper open end of the cylinder. The rhomboidal shape of the opening 20 is however preferred because it permits the leading end of the piston 12 to penetrate more smoothly into the cylinder 10 without interfering with the opening as might happen if the opening was rectangularly arranged perpendicularly to the cylinder 10.

Figure 5:
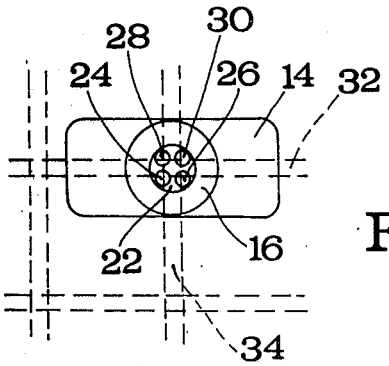
FIG. 5 is a top plan view showing the application of a syringe having four adjacent tubular spray nozzles to a junction of racket netting.

To ensure a more uniform distribution of the adhesive around a junction of netting, the syringe may also be provided with four spray nozzles equally peripherally spaced around the axis of the cylinder 10. FIG. 5 shows the use of such a syringe having four spray nozzles 24, 26, 28, 30 for the application of adhesive to a junction between two strings 32, 34 of racket netting. The four spray nozzles are placed each in a corner between the two strings 32, 34 and then the piston 12 is depressed to a predetermined extent so as to discharge from the four spray nozzles 24, 26, 28, 30 four identical doses of liquid adhesive mixture which will simultaneously adhere both to the string 32 and 34. Again the dosage will be determined empirically by the operator but the syringe will always ensure that the four deposited drops of liquid adhesive are exactly of the same size.

Obviously the deposited drops will be smaller than those deposited with the syringe having only two spray nozzles as the diameter of the spray nozzles 24, 26, 28, 30 in the syringe with four spray nozzles will conveniently be made smaller than in the syringe having only two spray nozzles.

Although two preferred embodiments of the invention have thus been described in detail and illustrated in the accompanying drawings, it will be obvious that numerous changes and modifications obvious to one skilled in the art may be made therein without departing from the scope of the invention as defined by the appended claims.

I claim:

1. A syringe for applying adhesive resin to the junctions of racket netting, comprising a reservoir cylinder to contain such adhesive resin and an injecting piston to expel adhesive resin from such reservoir cylinder and at least two separate adjacent parallel tubular spray nozzles fluidically coupled with and extending from the end of the reservoir cylinder to provide simultaneous, substantially identical doses of adhesive resin therethrough to such junctions.

2. A syringe as claimed in claim 1, comprising four adjacent parallel tubular spray nozzles extending from the end of the reservoir cylinder acted upon by the injection piston.

3. A syringe as claimed in claim 1, wherein said tubular spray nozzles are spaced from one another by a distance corresponding to the diameter of a string of racket netting.

4. A syringe as claimed in claim 1, wherein the open ends of said tubular spray nozzles are cut obliquely so as to form spouts directed toward the center of a junction of racket netting when the syringe is applied thereto.

5. A syringe as claimed in claim 1, wherein a rectangular flange serving as a handle extends perpendicularly outwardly from a position near an upper open end of said reservoir cylinder.

6. A syringe as claimed in claim 5, wherein said tubular spray nozzles are frictionally mounted on a connection nipple extending downwardly from a restricted bottom end of said reservoir cylinder so that the angular position of said tubular spray nozzles with respect to said rectangular flange can be varied as desired.

7. A syringe as claimed in claim 1, wherein said reservoir cylinder has a rectangular opening in its peripheral wall near its upper end for the introduction of the adhesive resin to be applied.

8. A syringe as claimed in claim 7, wherein said rectangular opening has a substantially rhomboidal shape.

9. A syringe as claimed in claim 1, wherein said syringe is disposable and is constructed of an inexpensive, synthetic resin, and wherein said nozzles have an inner diameter of less than 8 millimeters.

10. A syringe for applying adhesive resin to the junctions of racket netting, comprising a reservoir cylinder to contain such adhesive resin and an injecting piston to expel adhesive resin from the reservoir cylinder and four separate, adjacent, parallel, tubular spray nozzles fluidically coupled with and extending from the end of the reservoir cylinder acted upon by the injecting piston, said four spray nozzles being substantially equally spaced around the axis of said reservoir cylinder by a distance approximately corresponding to the diameter of a string of said racket netting to apply substantially identical doses of adhesive resin to such junctions.

11. A syringe as claimed in claim 10, wherein the open ends of said tubular spray nozzles are cut obliquely, forming spouts directed toward the center of a junction of racket netting when the syringe is applied thereto.

12. A syringe, as claimed in claim 10, wherein a rectangular flange, serving as a handle, extends perpendicularly outwardly from a position near an upper open end of said reservoir cylinder.

13. A syringe, as claimed in claim 12, wherein said tubular spray nozzles are frictionally mounted on a connection nipple extending downwardly from a restricted bottom end of said reservoir cylinder so that the angular position of said tubular spray nozzles with respect to said rectangular flange can be varied as desired.

14. A syringe, as claimed in claim 10, wherein said reservoir cylinder has a substantially rhomboidal shaped opening in its peripheral wall near its upper end for the introduction of the adhesive resin to be applied.

* * * * *